US006851775B2

(12) United States Patent
Kaiser

(10) Patent No.: US 6,851,775 B2
(45) Date of Patent: Feb. 8, 2005

(54) REFRIGERATING UNIT

(75) Inventor: Mario Kaiser, Schwäbisch Gmünd (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/620,588

(22) Filed: Jul. 16, 2003

(65) Prior Publication Data

US 2004/0035129 A1 Feb. 26, 2004

Related U.S. Application Data

(62) Division of application No. 09/883,478, filed on Jun. 18, 2001, now Pat. No. 6,641,239, which is a continuation of application No. PCT/EP99/09793, filed on Dec. 10, 1999.

(30) Foreign Application Priority Data

Dec. 17, 1998 (DE) ..... 198 58 387

(51) Int. Cl.[7] ..... A47B 96/04
(52) U.S. Cl. ..... 312/404; 312/331
(58) Field of Search ..... 312/404, 331, 312/408, 334.7, 116, 402; 62/382

(56) References Cited

U.S. PATENT DOCUMENTS

| | | | |
|---|---|---|---|
| 1,758,550 | A | 5/1930 | Wolters |
| 1,806,174 | A | 5/1931 | Morin |
| 2,174,181 | A | 9/1939 | Rand |
| 2,801,146 | A | 7/1957 | Mikulas |
| 3,323,853 | A | 6/1967 | Stark |
| 4,320,934 | A | 3/1982 | Pöck et al. |
| 4,324,439 | A | 4/1982 | Hagen et al. |
| 5,040,856 | A | 8/1991 | Wilkins et al. |
| 5,409,309 | A | 4/1995 | Giddings et al. |

FOREIGN PATENT DOCUMENTS

| | | |
|---|---|---|
| JP | 05-340664 | 12/1993 |
| JP | 11-294943 | 10/1999 |
| JP | 2000-70060 | 7/2000 |

*Primary Examiner*—Lanna Mai
*Assistant Examiner*—Hanh V. Tran
(74) *Attorney, Agent, or Firm*—Laurence A. Greenberg; Werner H. Stemer; Ralph E. Locher

(57) ABSTRACT

A refrigerating unit includes a cooling chamber, a storage compartment removably guided within the chamber as far as a closing position, and a disengagement device. The chamber has a parallel-guide disposed on its sides. The guide has a mating toothed configuration, two rollers rigidly coupled, lying opposite each other, and each having an external toothed configuration with a pitch circle diameter to be rollingly coupled to the mating toothed configuration. The guide has an end section reached by the rollers near the closing position. One of the mating toothed configuration and the rollers is positionally fixed. The disengagement device disengages the mating toothed configuration from the external toothed configuration of the rollers and is at the end section and has a disengagement length compensating for oblique positioning of the compartment in and counter to a movement direction arising from an offset of the rollers along the mating toothed configuration.

15 Claims, 3 Drawing Sheets

10
14
22
35
28
30
29
17
23
24
18
24
20
19
21
33
40
B
25
12
15
16
39
27
26
11
13

35
22
32
24
23
38
17
20
21
33
31
24
19
18
30
32
38
39
35
37
29
28
30
25

REFRIGERATING UNIT

CROSS-REFERENCE TO RELATED APPLICATION

This is a divisional of U.S. application Ser. No. 09/883,478, filed Jun. 18, 2001, now U.S. Pat. No. 6,641,239, which was a continuation of International Application No. PCT/EP99/09793, filed Dec. 10, 1999, which designated the United States, and which was not published in English.

BACKGROUND OF THE INVENTION

Field of the Invention

The invention relates to a refrigerating unit having at least one cooling chamber that is equipped with a storage compartment that is guided in a drawer-like manner and has, at least on its two longitudinal sides lying in the insertion direction, a parallel-guiding device that is formed by a rack-like mating toothed configuration and of two rollers that are coupled at least approximately rigidly to each other. The rollers lie opposite each other at least substantially on the same axis and have an external toothed configuration of identical pitch circle diameter that is able to roll along the mating toothed configuration, in which case either the mating toothed configuration or the rollers are disposed in a positionally fixed manner.

European Patent Application EP 07 18 574 A1 discloses a refrigerating unit having a cooling compartment that is equipped with storage compartments that can be pulled out in a drawer-like manner. The larger of the storage compartments supports a door for closing the cooling compartment. The storage compartment that is provided with the door is equipped with a parallel-guiding device. The parallel-guiding device is respectively formed by a rack-like mating toothed configuration provided on the side walls of the cooling compartment and by externally toothed rollers that are provided on the side walls of the storage compartment. The rollers interact with the mating toothed configuration. In such a type of parallel guidance, to avoid an oblique position of the storage compartment arising because the rollers on the storage compartment are not correctly inserted into the mating toothed configuration, a restricted guiding device connected upstream of the mating toothed configuration in the insertion direction of the storage compartment is proposed. The device serves to bring the externally toothed rollers on the storage compartment into engagement with the mating toothed configuration in a movement running at least substantially perpendicularly with respect to the mating toothed configuration. It, therefore, avoids an oblique position during the procedure of inserting the storage compartment into the guides provided in the cooling compartment. In spite of such a measure, it has turned out that if the storage compartment is not correctly maneuvered, misalignment occurs. Specifically, the storage compartment is not prevented from passing into an oblique position in which the externally toothed rollers (rigidly connected to each other per se) move asynchronously with respect to each other during movement of the storage compartment. Also in the oblique position, with the storage compartment in the closed position, a gap arises between its seal and the supporting edge provided for the edge on the housing. Due to the presence of the gap, a rise in temperature of the storage compartment results.

SUMMARY OF THE INVENTION

It is accordingly an object of the invention to provide a refrigerating unit that overcomes the hereinafore-mentioned disadvantages of the heretofore-known devices of this general type and that is able to correct an oblique position of the storage compartment using simple structural measures.

With the foregoing and other objects in view, there is provided, in accordance with the invention, a refrigerating unit, including a cooling chamber having two longitudinal sides, a storage compartment removably guided into and out of the cooling chamber in a movement direction, the storage compartment removably guided into the cooling chamber along the movement direction as far as a closing position, the cooling chamber having a parallel-guiding device disposed on the two longitudinal sides along the movement direction, the parallel-guiding device having a mating toothed configuration, two rollers coupled approximately rigidly to each other, lying opposite each other at least substantially on a given axis, and each having an external toothed configuration with an identical pitch circle diameter to be rollingly coupled to the mating toothed configuration, one of the mating toothed configuration and the rollers positionally fixed with respect to the cooling chamber, and an end section reached by the rollers along the movement direction by the closing position of the storage compartment, and a disengagement device for disengaging at least part of the mating toothed configuration from the external toothed configuration of at least one of the two rollers, the disengagement device disposed at the end section and having a disengagement length sufficient to compensate for an oblique positioning of the storage compartment in and counter to the movement direction arising from an offset of the two rollers from one another along the mating toothed configuration.

The invention provides a device that is capable of disengaging at least one of the mating toothed configurations and the external toothed configuration in engagement therewith of the roller from the roller at its section that is reached by the roller at the end of the closing movement of the storage compartment. At such a position, the length of the disengagement is capable of compensating for at least one oblique position of the storage compartment in and counter to its insertion direction, which oblique position arises as a result of the rollers that are rolling along the mating toothed configurations becoming offset from each other by a tooth pitch.

With the invention, when the storage compartment is in the closed position, an oblique position, which may be caused, for example, by a shock-like, eccentric application of force to the storage compartment, is automatically compensated for. As a result, the storage compartment door, which is equipped with a seal, always bears tightly against the opening edge of the access opening to the cooling compartment. As such, a formation of a gap between the seal provided on the storage compartment door and the opening edge of the access opening to the cooling compartment is inevitably avoided. And, even if the storage compartment is incorrectly handled, the specified cooling compartment temperature is always reliably ensured with the storage compartment in the closed position. The closure is reliably ensured because, after each closing procedure, the storage compartment is automatically moved from its oblique position into a positionally correct position, in which the door provided on the storage compartment runs at least substantially parallel to the opening edge of the cooling compartment.

In accordance with another feature of the invention, the storage compartment is removably guided into and out of the cooling chamber as a drawer.

In accordance with a further feature of the invention, the disengagement device is disposed at the end section and has a disengagement length sufficient to compensate for an oblique positioning of the storage compartment in and counter to the movement direction arising from a tooth pitch offset of the two rollers from one another along the mating toothed configuration.

In accordance with an added feature of the invention, the disengagement device is a tooth space that is provided on the mating toothed configuration and is disposed at that end section of the mating toothed configuration that is rolled over by the roller at the end of the closing procedure of the storage compartment.

By the removal of teeth from the mating toothed configuration and, therefore, the provision of a tooth space, an alignment of the storage compartment, which is in an oblique position during the closing procedure, is brought about in a particularly simple manner at the end of the closing procedure. In particular, providing a tooth space means that an oblique position of different extent can also be corrected in a simple manner by the removal of a plurality of teeth from the mating toothed configuration. Moreover, the provision of a tooth space makes it possible to particularly precisely influence the variables (such as tooth module and pitch circle diameter—variables characterizing the external toothed configuration on the roller and determining the extent of the oblique position and, therefore, of the gap arising in the closed position) and therefore to correct the storage compartment, which has originally been set obliquely, with particular positional accuracy. In the event that the mating toothed configuration is produced integrally from a plastic injection molding, a tooth space caused, for example, by the absence of a plurality of teeth can be produced particularly simply.

In accordance with an additional feature of the invention, the parallel-guiding device has two parts each having the mating toothed configuration for a respective one of the two rollers, each of the mating toothed configurations has teeth with at least one tooth height, the tooth space, and a feeding region for the rollers. The feeding region has teeth with an increasingly rising tooth height at least approximately continuously to a final tooth height and the tooth space is adjoined by the feeding region.

Thus, in addition to the possibility of being able to compensate for an oblique position of the storage compartment, a particularly jolt-free feeding of the externally toothed rollers from the tooth spaces into the mating toothed configuration is ensured.

The mating toothed configurations are disposed in a particularly expedient manner if, in accordance with yet another feature of the invention, it is provided that in each case one of the mating toothed configurations is provided on one of the side walls of the cooling chamber where the side walls are disposed in the insertion direction of the storage compartment.

Mating toothed configurations disposed as such can be disposed in a particularly rigid manner in terms of position and shape. For example, they can be in the form of a U-shaped guide profile that is equipped on one of its limbs with the mating toothed configuration and that is either placed directly onto the side walls or is embedded into the side walls in a recess corresponding to its external contour and is additionally supported there for increasing the dimensional rigidity of the guide profile, by the thermal insulation of the refrigerating unit, which insulation is produced by coating it with foam. In the event that the mating toothed configuration is provided on a limb of a plastic guide profile that is of U-profile-like shape in cross section, the mating toothed configuration can be produced not only in a particularly simple manner with different tooth pitches and tooth sizes, but also can be exchanged at particularly reasonable cost in the event of damage.

The feeding from the tooth-space region into the mating toothed configuration is configured in a particularly user-friendly manner if, in accordance with yet a further feature of the invention, it is provided that the feeding region for the rollers is mounted downstream in tooth spaces in the pull-out direction of the storage compartment from the cooling chamber.

In accordance with yet an added feature of the invention, the disengagement device is configured as a sloping plane that pushes the external toothed configuration of the roller, which is acted upon by an energy accumulator, out of engagement with the mating toothed configuration in the axial direction of the roller immediately before its end section that is rolled over by the external toothed configuration of the roller at the end of the closing movement of the storage compartment. In which case, the roller is supported in the cooling chamber by a running surface. Preferably, the energy accumulator is a spring.

In accordance with yet an additional feature of the invention, the disengagement device is a sloping plane pushing the external toothed configuration out of engagement with the mating toothed configuration in a direction along the given axis immediately before the storage compartment reaches the closing position.

By the possibility of being able to vary its slope, the sloping plane provides the conditions for being able to undertake the movement of the externally toothed rollers, so as to bring them out of engagement or into engagement with the mating toothed configuration, in a particularly targeted manner in accordance with the existing space conditions.

In accordance with again another feature of the invention, the energy accumulator provides a force, and the roller is divided substantially perpendicularly with respect to the given axis into a positionally-fixed section having a smooth-faced running surface and an externally-toothed section displaceably mounted with respect to the given axis, in engagement with the mating toothed configuration; and supported on the positionally-fixed section by the energy accumulator, the externally-toothed section to be brought out of engagement with the mating toothed configuration counter to the force by the sloping plane at least immediately before the roller reaches the end section.

According to a further preferred embodiment of the subject matter of the invention, the roller is divided essentially perpendicularly with respect to its running axis into a positionally fixed section that is equipped with a smooth-faced running surface and an externally toothed section that is mounted displaceably in the axial direction of the roller, is in engagement with the mating toothed configuration and is supported on the positionally fixed section by an energy accumulator. In such a case, the displaceably mounted section is brought out of engagement with the mating toothed configuration counter to the action of the energy accumulator by the sloping plane at least immediately before its end section on the mating toothed configuration. The end section is rolled over at the end of the closing movement of the storage compartment.

As such, and in conjunction with the sloping plane, a particularly simple and reasonably priced support of the storage compartment is provided in the closed state in which the externally toothed section is disengaged from the mating toothed configuration.

In accordance with again a further feature of the invention, the externally-toothed section is to be brought out of engagement with the mating toothed configuration counter to the force by the sloping plane at least immediately before the storage compartment reaches the closing position.

In accordance with a concomitant feature of the invention, a roller of the two rollers has a running surface, the disengagement device is a sloping plane pushing the external toothed configuration out of engagement with the mating toothed configuration in a direction along the given axis approximately before the roller reaches the end section, and the running surface supports the roller in the cooling chamber approximately at the closing position.

Other features that are considered as characteristic for the invention are set forth in the appended claims.

Although the invention is illustrated and described herein as embodied in a refrigerating unit, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
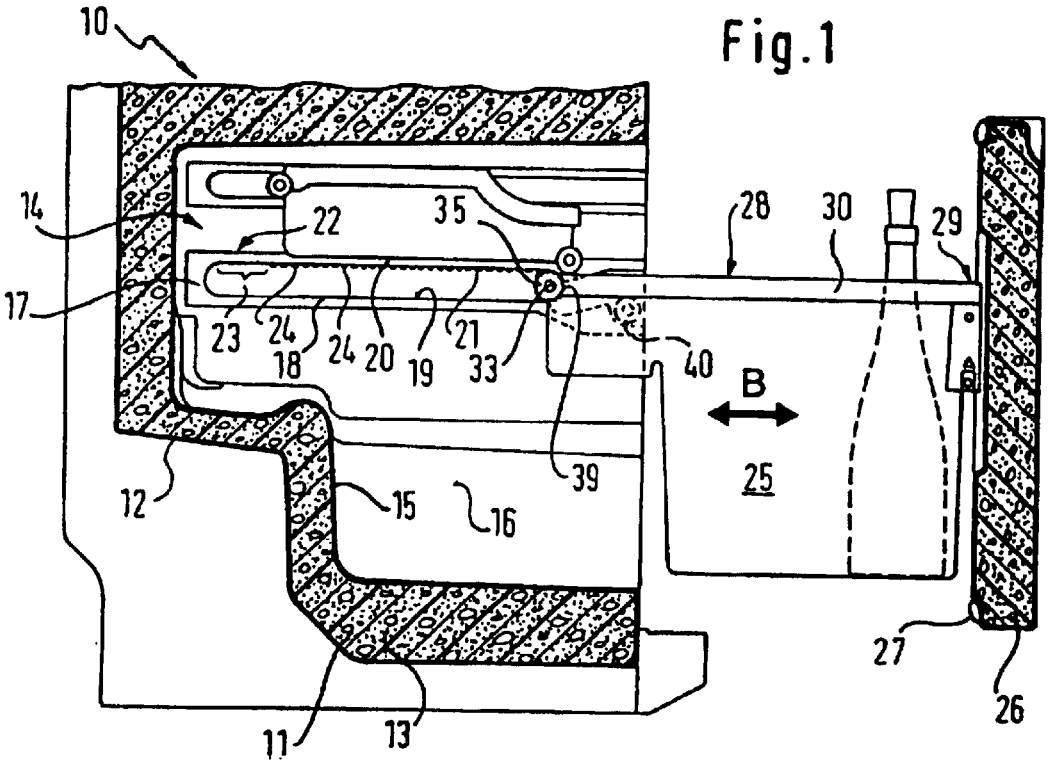
FIG. 1 is a diagrammatic, side elevational view of a multi-temperature household cooling unit having two storage compartments disposed one above the other in its cooling chamber according to the invention, with the lower one having externally toothed rollers engaging a mating toothed configuration provided on guide profiles on the side walls of the cooling chamber.

In all the figures of the drawing, sub-features and integral parts that correspond to one another bear the same reference symbol in each case.

Referring now to the figures of the drawings in detail and first, particularly to FIG. 1 thereof, there is shown an illustration of the lower section of a multi-temperature household cooling unit 10 having a heat-insulating housing 11 with external cladding 12, a heat-insulating layer 13 produced by coating it with foam, and an internal cladding 15 that is formed without cutting and serves for lining a cooling chamber 14. The internal cladding 15 is provided, on its mutually opposite side walls 16 (only one of which is shown), with guide profiles that are disposed at a distance one above another, that have a U-shaped cross section, and that are inserted into the side walls 16. FIG. 1 depicts two storage compartments disposed one above the other in the cooling chamber 14. The guide profile 17 that is disposed lower down in the cooling chamber 14 is provided with a smooth-faced guide track 19 on its U-profile limb 18, which is disposed lower down when installed. Opposite the guide track 19, the guide profile 17 has, on its second, higher up limb 20, a mating toothed configuration 21 that is shaped in the manner of a rack. The inside of the limb 20 facing the guide track 19 is integrally formed on the guide profile 17 and it is manufactured from a plastic injection molding. The mating toothed configuration 21 has, on its end section 22 at the end of the mating toothed configuration 21, a tooth space 23 that is formed by the absence of one or more teeth 24 of the mating toothed configuration 21. The end section 22 faces away from the opening side of the cooling chamber 14. The teeth 24 are disposed directly one behind the other, where, in a tooth module of 1.5 and a pitch circle diameter of 17.5 mm for a toothed wheel described in greater detail further on, a tooth space having a disengagement length L of at least four missing teeth has been tried and tested.

The mating toothed configuration 21 serves for the parallel guidance of a storage compartment 25 that can be pulled in a drawer-like manner out of the cooling chamber and on whose front side is a heat-insulating door 26. The heat-insulating door 26 serves to close the cooling chamber 14 and is provided with a magnetic seal 27 around the periphery of its lateral edges facing the cooling compartment 14. The magnetic seal 27 rests in a sealing manner on the opening edge of the cooling chamber 14 when the door 26 is closed. At the free end of the storage compartment 25 walls that bound the compartment chamber, the storage compartment 25 is equipped with a frame-like surround 28 that is formed from strut-like sections 29 to 31 of which, strut section 29 faces the door 26 and serves to fasten the surround 28 to the storage compartment 25. Of the other strut sections 30, 31, strut sections 30 run parallel to the side walls 16 of the internal cladding 15, while strut section 31 is provided on that section of the storage compartment 25 that is remote from the door and connects the lateral strut sections 30 to each other, in the same manner as is brought about by that strut section 29 that is near the door.

Figure 2:
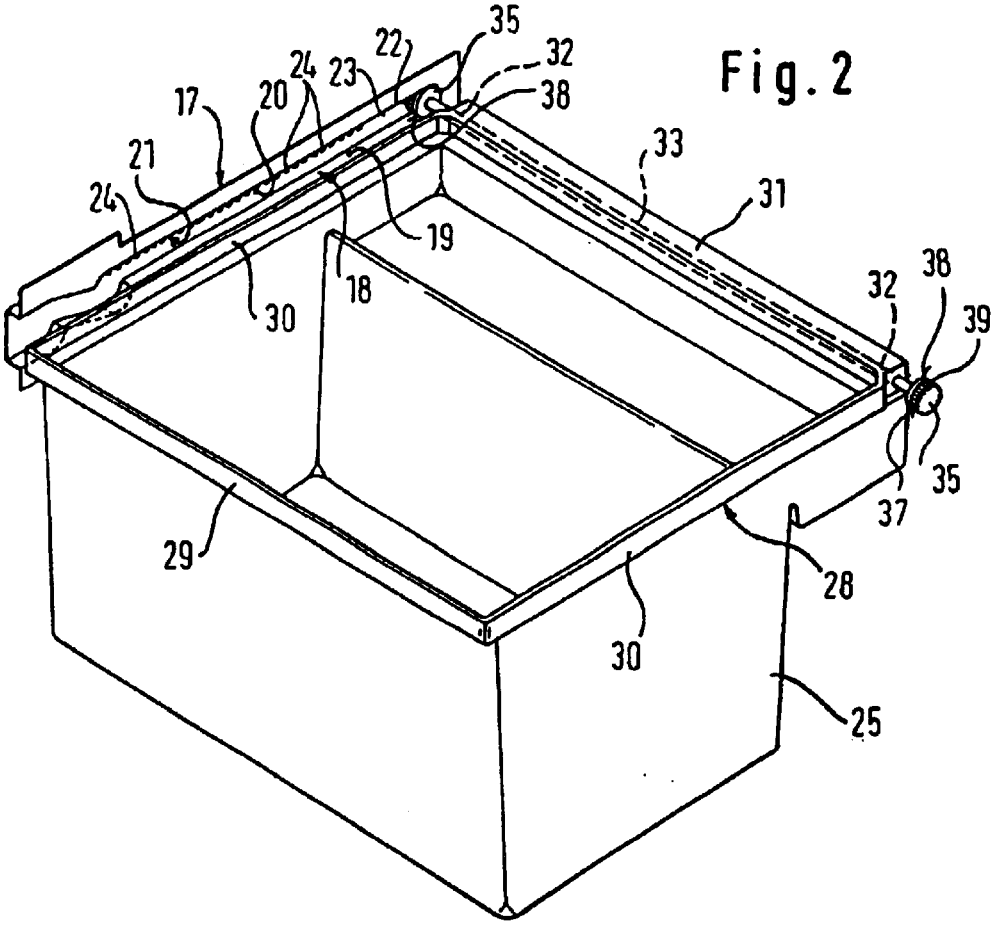
FIG. 2 is a perspective view from above of the lower storage of FIG. 1 without a door and with toothed rollers coupled to each other through a spindle, and with one of the guide profiles with the mating toothed configuration having a tooth space for disengaging the roller.

As can be seen in particular from FIG. 2, strut section 31 remote from the door has, on its lateral end sections, bearing sockets 32 for the mounting of a bearing spindle 33 that, at least to a very large extent, is twist-proof. See also FIG. 3. At its free end sections that protrude with respect to the bearing sockets 32, the bearing spindle 33 is provided with a respective flattened portion 34 (see FIG. 4) that interacts in a positive-locking manner with a hub 36 sitting in the center of a roller 35. By the positive engagement, the rollers 35 that are provided at both ends of the bearing spindle 33 are coupled rigidly to each other in an aligned tooth position through the bearing spindle 33 in a manner secured against twisting. In the exemplary embodiment, the rollers 35 are fixed axially on the bearing spindle at one end by the lateral edges of the transverse strut 31 and are fixed at the other end by securing rings that are provided in the vicinity of the two free end sections of the bearing spindle 33. The rollers 35 engage in retaining grooves (not illustrated in greater detail and not referred to in greater detail) and are conventionally used for such purposes. See, i.e., FIG. 3.

Figure 3:
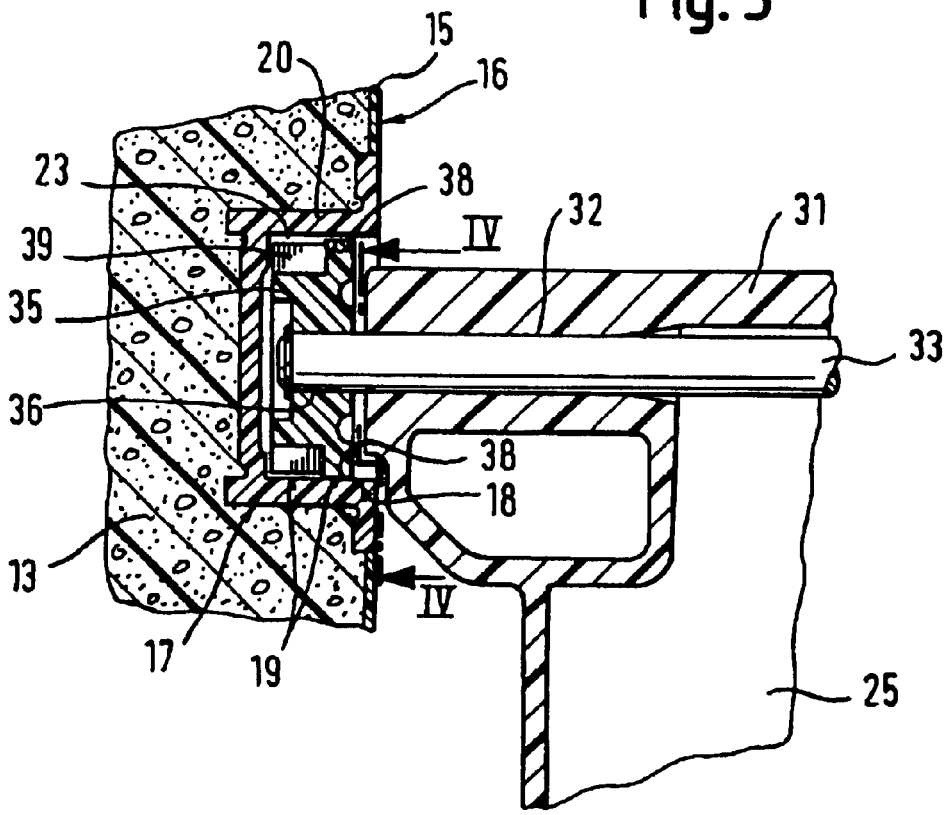
FIG. 3 is a fragmentary, cross-sectional view of the heat-insulating housing from above the cooling unit of FIG. 1 in a region of the guide profiles remote from the door.
Figure 4:
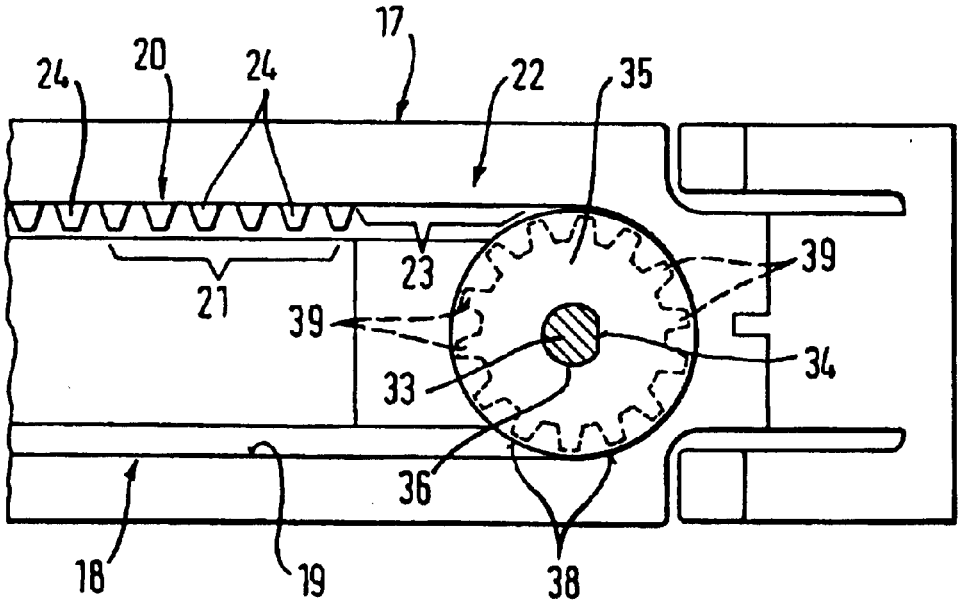
FIG. 4 is a fragmentary, cross-sectional view of the guide rail according to FIG. 3 in the region of the tooth space along the line IV—IV.

As emerges, in particular, from FIG. 3, the rollers 35 that are supported on the bearing spindle 33 in a manner secured against twisting and are configured as a stepped circular cylinder are divided on their circumferential surface 37 into two sections that differ in width. The sections correspond essentially to the width of the rollers 35 and of which a relatively narrow section disposed adjacent to the lateral edges of the strut section 31 is equipped with a smooth-faced tread 38. Directly adjacent to the section provided with the smooth-faced tread 38, the roller 35 has a second section that is wider, that springs back radially with respect to the first section, and that has on its circumferential surface an external toothed configuration 39 equipped with the same number of teeth and same tooth module for both rollers 35. See also FIG. 4.

FIG. 1, in particular, shows, for parallel guidance of the storage compartment 25 (moveable in a drawer-like manner in the direction of the double arrow B), the external toothed configuration 39 in engagement with the mating toothed configuration 21 provided on the upper limb 20 of the guide profile 17. When the storage compartment 25 is moved in the direction of the double arrow B, the smooth-faced tread 38 of the roller 35 rolls along the guide track 19 of the lower limb to support the storage compartment 25 at its end that is remote from the door, and, together with a respective roller 40 (shown in dashed lines), forms a type of roller pull-out for the storage compartment 25. Roller 40 is disposed in a positionally-fixed manner on the opening edge of the cooling chamber 14, is supported on the lower side of the lateral strut sections 30, and is smooth-faced on its circumferential side.

If the storage compartment 25 is in its state that is illustrated in FIG. 2, in which it is inserted into the cooling chamber 14, then the external toothed configuration 39 of one of the rollers 35 is disengaged from the mating toothed configuration 21 because of the tooth space 23 (provided on the end section 22 remote from the door on the mating toothed configuration 21 assigned to the roller 35). Such disengagement ensures that the magnetic seal 27 bears on all sides against the opening edge of the cooling chamber 14 when the door 26 is in the closed state. Even if, during the procedure of inserting the cooling compartment 25 into the cooling chamber 14, an oblique position of the storage compartment 25 is caused by one of the externally toothed rollers 35 running ahead due to an improper, eccentric and simultaneously shock-like application of force to the door 12, the oblique position is corrected again when the door is in the closed state. Such correction takes place as a result of the tooth space 23 on one of the mating toothed configurations 21 enabling the oblique position to be eliminated and tight bearing of the magnetic seal 27 against the opening edge of the cooling chamber 14 to be produced.

Figure 5:
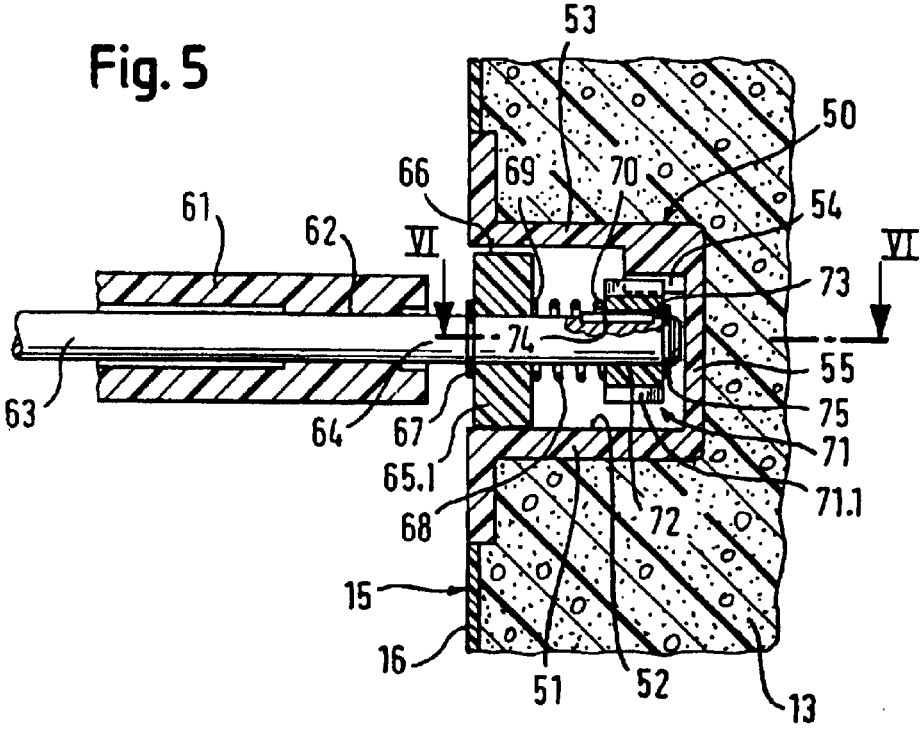
FIG. 5 is a fragmentary, cross-sectional view of an alternative configuration of one of the guide profiles having a sloping plane for disengaging a toothed wheel in engagement with the mating toothed configuration from the front of the compartment of FIGS. 1 and 3.
Figure 6:
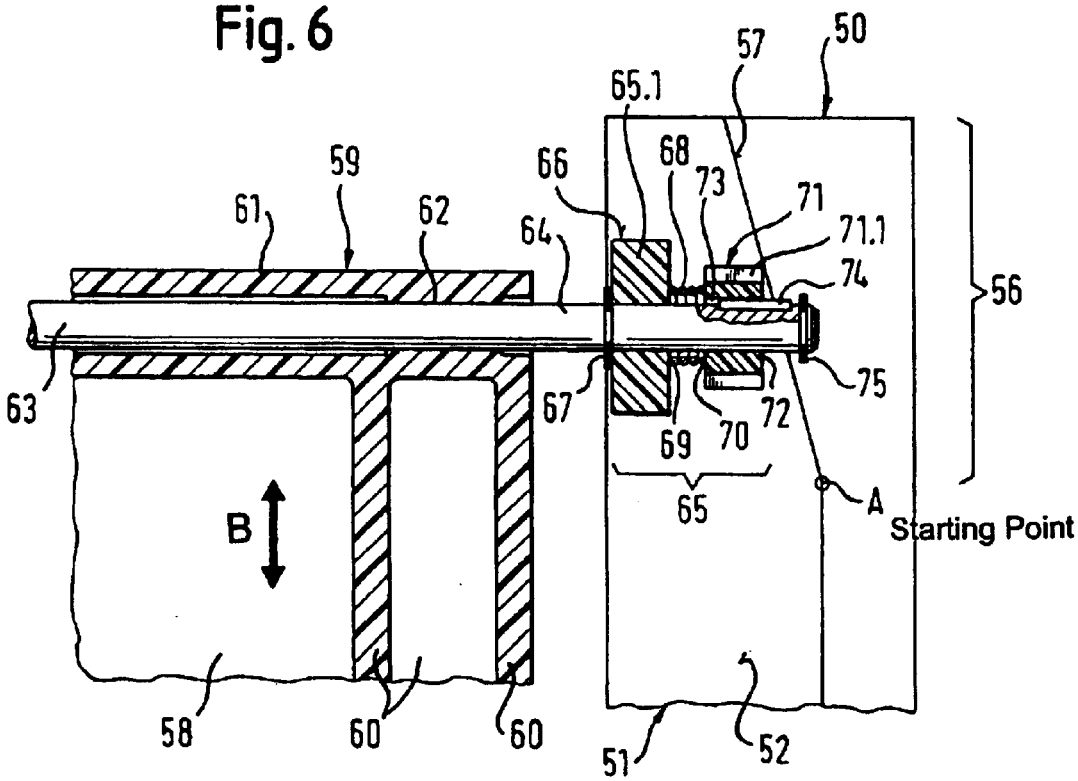
FIG. 6 is a fragmentary, cross-sectional view of an alternative configuration of FIG. 5 along the line VI—VI having the toothed wheel disengaged at the end remote from the door by the sloping plane.

FIG. 5 shows an alternative embodiment of one of the guide profiles 50. The guide profile 50 is sitting in a hollow of the internal cladding 15 on the side walls 16. Like the guide profile 17, the guide profile 50, which is fixed to the two side walls 16 of the internal cladding 15, is substantially a U-profile in cross section. Such U-profile is equipped in the fitted position with a smooth-faced guide track 52 provided on the inside of its lower-disposed limb 51. Furthermore, when fitted, the guide profile 50 is provided, on its higher-disposed limb 53, with a mating toothed configuration 54. The mating toothed configuration 54 is configured as a rack, is disposed virtually over the entire length of the guide profile 50, and is provided directly adjacent to a base that connects the two limbs 51 and 53 and serves as a back wall 55 facing the heat insulation 13. On the end section 56 of the back wall 55, which is disposed opposite the opening of the cooling chamber 14, the back wall 55 is provided with a sloping plane 57 (see FIG. 6, in particular) that is integrally formed on the back wall 55 and that extends from a starting point A within the end section 56 obliquely over the mating toothed configuration 54 to the free end of the end section 56.

The mating toothed configuration 54 (provided on each of the two guide profiles 50) serves for the parallel guiding of a storage compartment 58 that has a similar configuration as that of the storage compartment 25. The compartment 58 is only shown in part in FIG. 6 and can be moved in a drawer-like manner out of the cooling compartment 14 in the direction of the double arrow B. Like the storage compartment 25, compartment 58 is provided with a frame-like surround 59 on its opening edge. The surround 59 is formed from a plurality of strut sections. The strut sections include two laterally extending struts 60 produced by the internal gas pressure method, a non-illustrated strut on the front side, and a transverse strut 61 that is remote from the door and connects the lateral struts 60 to each other on their rear section remote from the door. The transverse strut 61 is equipped at its two lateral end sections with a bearing socket 62 (see FIG. 6) for mounting a bearing spindle 63 that has a twist-proof configuration at least to a very large extent. The spindle 63 is mounted rotatably in the bearing sockets 62 and is fixed in the axial direction with respect to the bearing sockets by a non-illustrated fixing device. The bearing spindle 63 has end sections 64 that protrude with respect to the lateral edges of the bearing sockets 62 and on which a roller 65 is fixed. The roller 65 is disposed adjacent to the lateral edges of the bearing socket 62. The roller 65 is a circular cylinder, is divided perpendicularly and with respect to its axial direction and has a first section 65.1 that is equipped on its circumferential side with a smooth-faced tread 66. On a side of the section 65.1 facing the bearing socket 62, the section 65.1 is supported axially in the axial direction by a resilient securing washer 67 that engages in a groove. Another side of the section 65.1 that lies opposite the first side serves to support a compression spring 68 that is provided as an energy accumulator and is resiliently supported by one of its free ends 69 on the section 65.1 and by its other free end 70 on a second section 71 of the roller 65. The second section 71 is configured as a toothed wheel provided with an external toothed configuration 71.1. The second section 71 is mounted on the bearing spindle 63 both in a manner such that it can be displaced in the axial direction of the bearing spindle 63 and also in a manner such that it is secured against twisting. For the displaceable mounting of the section 71, it has a hub 72 that sits in its center and is provided on its circumferential side with a groove 73 that extends in its axial direction and in which an adjusting spring 74, which is fixed on the end section 64, engages in a positive-locking manner. The displacement path of the section 71 towards the free end of the end section 64 is limited by a resilient securing washer 75 that is placed there in a positive-locking manner. In addition to the two-part roller 65, a roller as used in accordance with the first embodiment of the invention, for example, is provided on the second end section 64 of the bearing spindle 63.

If the storage compartment is moved from its open position (see FIG. 1) in which the section 71 engages with its external toothed configuration 71.1 in the mating toothed configuration 54) and then into the cooling chamber 14, the section 71 is pushed by the sloping plane 57 at the end of the insertion path out of engagement with the mating toothed configuration 54 by the sloping plane 57 that is disposed on the guide profile 50 that faces the section 71. As a result, an oblique position of the storage compartment 58 is corrected by the disengagement (the oblique position possibly arising because of an improper procedure of inserting the storage compartment 58). Thus, the magnetic seal 27 of the door 26 provided at the front end of the storage compartment 58 sealingly rests on all sides against the opening edge of the cooling chamber 14.

I claim:

1. A refrigerating unit, comprising:

a cooling chamber having two longitudinal sides;

a storage compartment removably guided into and out of said cooling chamber in a movement direction, said storage compartment removably guided into said cooling chamber along said movement direction as far as a closing position;

said cooling chamber having a parallel-guiding device disposed on said two longitudinal sides along said movement direction;

said parallel-guiding device having:

a mating toothed configuration;

two rollers coupled approximately rigidly to each other, lying opposite each other at least substantially on a given axis, and each having an external toothed configuration with an identical pitch circle diameter to be rollingly coupled to said mating toothed configuration, one of said mating toothed configuration and said rollers positionally fixed with respect to said cooling chamber, a roller of said two rollers having a running surface, said running surface supporting said roller in said cooling chamber near said closing position; and an end section reached by said rollers along said movement direction by said closing position of said storage compartment; and a disengagement device for disengaging at least part of said mating toothed configuration from said external toothed configuration of at least one of said two rollers, said disengagement device:

being disposed at said end section and having a disengagement length sufficient to compensate for an oblique positioning of said storage compartment in and counter to said movement direction arising from an offset of said two rollers from one another along said mating toothed configuration; and being a sloping plane pushing said external toothed configuration out of engagement with said mating toothed configuration in a direction along said given axis approximately before said storage compartment reaches said closing position.

2. The refrigerating unit according to claim 1, wherein said two rollers each have an energy accumulator for pressing said external toothed configuration against said disengagement device.

3. The refrigerating unit according to claim 2, wherein said energy accumulator is a spring.

4. The refrigerating unit according to claim 1, wherein said disengagement device is a sloping plane pushing said external toothed configuration out of engagement with said mating toothed configuration in a direction along said given axis immediately before said storage compartment reaches said closing position.

5. The refrigerating unit according to claim 2, wherein:

said energy accumulator provides a force; and said roller is divided substantially perpendicularly with respect to said given axis into:

a positionally-fixed section having a smooth-faced running surface; and an externally-toothed section displaceably mounted with respect to said given axis, in engagement with said mating toothed configuration; and supported on said positionally-fixed section by said energy accumulator, said externally-toothed section to be brought out of engagement with said mating toothed configuration counter to said force by said sloping plane at least immediately before said roller reaches said end section.

6. The refrigerating unit according to claim 5, wherein said externally-toothed section is to be brought out of engagement with said mating toothed configuration counter to said force by said sloping plane at least immediately before said storage compartment reaches said closing position.

7. The refrigerating unit according to claim 1, wherein:

said disengagement device is a sloping plane pushing said external toothed configuration out of engagement with said mating toothed configuration in a direction along said given axis approximately before said roller reaches said end section; and said running surface supports said roller in said cooling chamber approximately at said closing position.

8. A refrigerating unit, comprising:

a cooling chamber having two longitudinal sides;

a storage compartment removably guided into and out of said cooling chamber in a movement direction, said storage compartment removably guided into said cooling chamber along said movement direction as far as a closing position;

said cooling chamber having a parallel-guiding device disposed on said two longitudinal sides along said movement direction;

said parallel-guiding device having:

a mating toothed configuration;

two rollers coupled approximately rigidly to each other, lying opposite each other at least substantially on a given axis, and each having an external toothed configuration with an identical pitch circle diameter to be rollingly coupled to said mating toothed configuration, one of said mating toothed configuration and said rollers positionally fixed with respect to said cooling chamber; and an end section reached by said rollers along said movement direction by said closing position of said storage compartment; and means for disengaging at least part of said mating toothed configuration from said external toothed configuration of at least one of said two rollers, said disengagement means disposed at said end section and having a disengagement length sufficient to compensate for an oblique positioning of said storage compartment in and counter to said movement direction arising from an offset of said two rollers from one another along said mating toothed configuration.

9. A refrigerating unit, comprising:

a cooling chamber having two longitudinal sides;

a storage compartment removably guided into and out of said cooling chamber in a movement direction, said storage compartment removably guided into said cooling chamber along said movement direction as far as a closing position;

said cooling chamber having a parallel-guiding device disposed on said two longitudinal sides along said movement direction;

said parallel-guiding device having:

a mating toothed configuration;

two roller assemblies coupled approximately rigidly to each other, lying opposite each other at least substantially on a given axis, and each having a respective external toothed configuration with an identical pitch circle diameter to be rollingly coupled to said mating toothed configuration and each having a respective roller section, one of said mating toothed configuration and said roller assemblies positionally fixed with respect to said cooling chamber, said roller section having a running surface, said running surface supporting a respective one of said roller assemblies in said cooling chamber near said closing position; and an end section reached by said roller assemblies along said movement direction by said closing position of said storage compartment; and a disengagement device for disengaging at least part of said mating toothed configuration from said external toothed configuration of at least one of said two roller assemblies, said disengagement device:

being disposed at said end section and having a disengagement length sufficient to compensate for an oblique positioning of said storage compartment in and counter to said movement direction arising from an offset of said two roller assemblies from one another along said mating toothed configuration; and being a sloping plane pushing said external toothed configuration out of engagement with said mating toothed configuration in a direction along said given axis approximately before said storage compartment reaches said closing position.

10. The refrigerating unit according to claim 9, wherein said two roller assemblies each have a respective energy accumulator for respectively pressing said external toothed configurations against said disengagement device.

11. The refrigerating unit according to claim 10, wherein said energy accumulator is a spring.

12. The refrigerating unit according to claim 9, wherein said disengagement device is a sloping plane pushing said external toothed configuration out of engagement with said mating toothed configuration in a direction along said given axis immediately before said storage compartment reaches said closing position.

13. The refrigerating unit according to claim 10, wherein:

said energy accumulator provides a force; and each of said roller assemblies is divided substantially perpendicularly with respect to said given axis into:

a positionally-fixed section having a smooth-faced running surface; and an externally-toothed section displaceably mounted with respect to said given axis, in engagement with said mating toothed configuration, and supported on said positionally-fixed section by said energy accumulator, said externally-toothed section to be brought out of engagement with said mating toothed configuration counter to said force by said sloping plane at least immediately before said roller assembly reaches said end section.

14. The refrigerating unit according to claim 13, wherein said externally-toothed section is to be brought out of engagement with said mating toothed configuration counter to said force by said sloping plane at least immediately before said storage compartment reaches said closing position.

15. The refrigerating unit according to claim 9, wherein:

said disengagement device is a sloping plane pushing said external toothed configuration out of engagement with said mating toothed configuration in a direction along said given axis approximately before said roller assembly reaches said end section; and said running surface supports said roller assembly in said cooling chamber approximately at said closing position.

* * * * *